US008424696B2

(12) United States Patent
Arustamov

(10) Patent No.: US 8,424,696 B2
(45) Date of Patent: Apr. 23, 2013

(54) SELF FILLING BOTTLE CAP FOR LIQUIDS

(76) Inventor: Gennadiy Arustamov, San Jose, CA (US)

( * ) Notice: Subject to any disclaimer, the term of this patent is extended or adjusted under 35 U.S.C. 154(b) by 505 days.

(21) Appl. No.: 12/692,676

(22) Filed: Jan. 25, 2010

(65) Prior Publication Data

US 2010/0282704 A1 Nov. 11, 2010

Related U.S. Application Data

(60) Provisional application No. 61/215,603, filed on May 8, 2009.

(51) Int. Cl.
*B65D 1/24* (2006.01)

(52) U.S. Cl.
USPC ..... 215/228; 220/521; 220/288; 206/219

(58) Field of Classification Search ..... 215/DIG. 8, 215/288, 44, 214, 217, 218; 220/521, 288, 220/289; 206/219, 217
See application file for complete search history.

(56) References Cited

U.S. PATENT DOCUMENTS

| | | | | |
|---|---|---|---|---|
| 1,297,244 | A * | 3/1919 | Rauen | 222/455 |
| 2,091,929 | A | 8/1937 | Kappenberg | |
| 2,446,085 | A | 7/1948 | Gronemeyer et al. | |
| 2,760,692 | A | 8/1956 | Buehlig | |
| 2,804,103 | A | 8/1957 | Wall | |
| 3,235,143 | A | 2/1966 | Goodrich | |
| 3,288,335 | A | 11/1966 | Steffenset al. | |
| 3,402,860 | A | 9/1968 | Torongo, Jr. | |
| 4,151,934 | A | 5/1979 | Saeki | |
| 4,170,318 | A | 10/1979 | Saeki et al. | |
| 4,269,319 | A | 5/1981 | Rubens | |
| 4,357,718 | A | 11/1982 | Corsette | |
| 4,756,433 | A | 7/1988 | Lin | |
| 4,776,972 | A * | 10/1988 | Barrett | 252/186.38 |
| 5,078,305 | A | 1/1992 | Glynn et al. | |
| 5,407,104 | A | 4/1995 | Santagiuliana | |
| 5,487,494 | A | 1/1996 | Robbins, III | |
| 5,772,017 | A * | 6/1998 | Kang | 206/222 |
| 6,068,165 | A | 5/2000 | Robbins, III | |
| 6,929,119 | B2 * | 8/2005 | Shaki | 206/221 |
| 6,932,231 | B2 * | 8/2005 | Haynes et al. | 220/212 |
| 7,066,354 | B2 * | 6/2006 | Stank et al. | 222/129 |
| 7,828,140 | B2 * | 11/2010 | Lee et al. | 206/222 |
| 2004/0226835 | A1 * | 11/2004 | Takahashi et al. | 206/219 |
| 2008/0073307 | A1 * | 3/2008 | Sweeney et al. | 215/228 |

* cited by examiner

*Primary Examiner* — Mickey Yu
*Assistant Examiner* — Kareen Rush
(74) *Attorney, Agent, or Firm* — Antonio Papageorgiou; Ostrow Kaufman LLP

(57) ABSTRACT

A bottle cap is provided that includes a bottle cap portion and an inner cup. Each of the cap portion and the inner cup has a bottom and an opening, and a cavity in between the bottom and the opening. The inner cup is preferably disposed within the cap portion in an orientation upside down relative to the cap portion and a certain distance from the cap so that the cavities of each are in communication with each other. This allows liquid to flow from the bottle that the cap is placed on into the cavity of inner cup, and from the cavity of the inner cup into the cavity of the cap when the bottle cap is tilted to the side and thereafter returned into an upright position.

9 Claims, 6 Drawing Sheets

SELF FILLING BOTTLE CAP FOR LIQUIDS

RELATED APPLICATION

This application claims the benefit of U.S. Provisional Application No. 61/215,603, filed May 8, 2009, which is hereby incorporated herein by reference.

BACKGROUND OF THE INVENTION

The present application relates generally to bottle caps and more specifically to self filling bottle caps for liquids.

A number of self filling bottle cap designs have been proposed, such as the bottle caps discussed in U.S. Pat. Nos. 2,091,929, 2,446,085, 2,760,692, 2,804,103, 3,235,143, 4,151,934, 4,170,318, 4,269,319, 4,357,718, 4,756,433, 5,078,305, 5,407,104, 5,487,494, and 6,068,165, each of which are hereby incorporated herein by reference. These designs, however, are relatively complicated to produce and use. Accordingly, there is a need for bottle caps that make the process of dispensing liquids from bottles to a cup more convenient and that are relatively simple to produce.

SUMMARY OF THE INVENTION

In at least one embodiment, a bottle cap is provided that includes a cap portion having an opening at one end, a bottom at another end, and sides extending between the opening and the bottom end, the bottom and sides forming a cavity in the cap portion; a cup having an opening at one end, a bottom at another end, and sides extending between the opening and the bottom end, the bottom and sides forming a cavity in the cup, the cup disposed within the opening of the cap portion in a direction up side down relative to the cap portion and the opening of the cup is spaced a distance away from the bottom of the cap portion such that the cavities of each of the cap portion and the cup are in communication with each other; and at least one holder that connects the cap portion and the cup.

The cup may have an opening with a perimeter and the cup may be disposed within the cap portion such that the cap portion and the cup are in communication with each other along essentially the entire perimeter of the cup opening. In this instance, the bottoms of each of the cap portion and the cup may have a geometric center point and the center point of the cup may be aligned with the center point of the cap portion so that the cup and cap share a common center point as viewed from a top of the cap or the cup. The holder may further have a first end and a second end opposite the first end, and the first end of the holder may extend from the bottom of the cap portion to the bottom of the cup. In one embodiment, the first end of the holder extends from a center point of the bottom of the cap portion to a center point of the bottom of the cup.

The holder may be a molded part of one of the cap portion and the cup, and the holder may be bonded to one of the cup and cap portion, respectively. The cap portion may include inside threads for removably coupling the bottle cap to a bottle.

In one embodiment, the cup has an essentially cylindrical shape with sides essentially perpendicular to the bottom of the cup. The cup may also have a composite shape that includes at least two different geometric shapes. In this instance, at least one of the geometric shapes may include a partial cone that tapes toward the opening of the cap. Similarly, at least one of the geometric shapes may include a cylinder situated toward the bottom of the cup and the partial cone may be situated toward the opening of the cup Additional aspects of the present invention will be apparent in view of the description which follows.

DETAILED DESCRIPTION OF THE INVENTION

Figure 1:
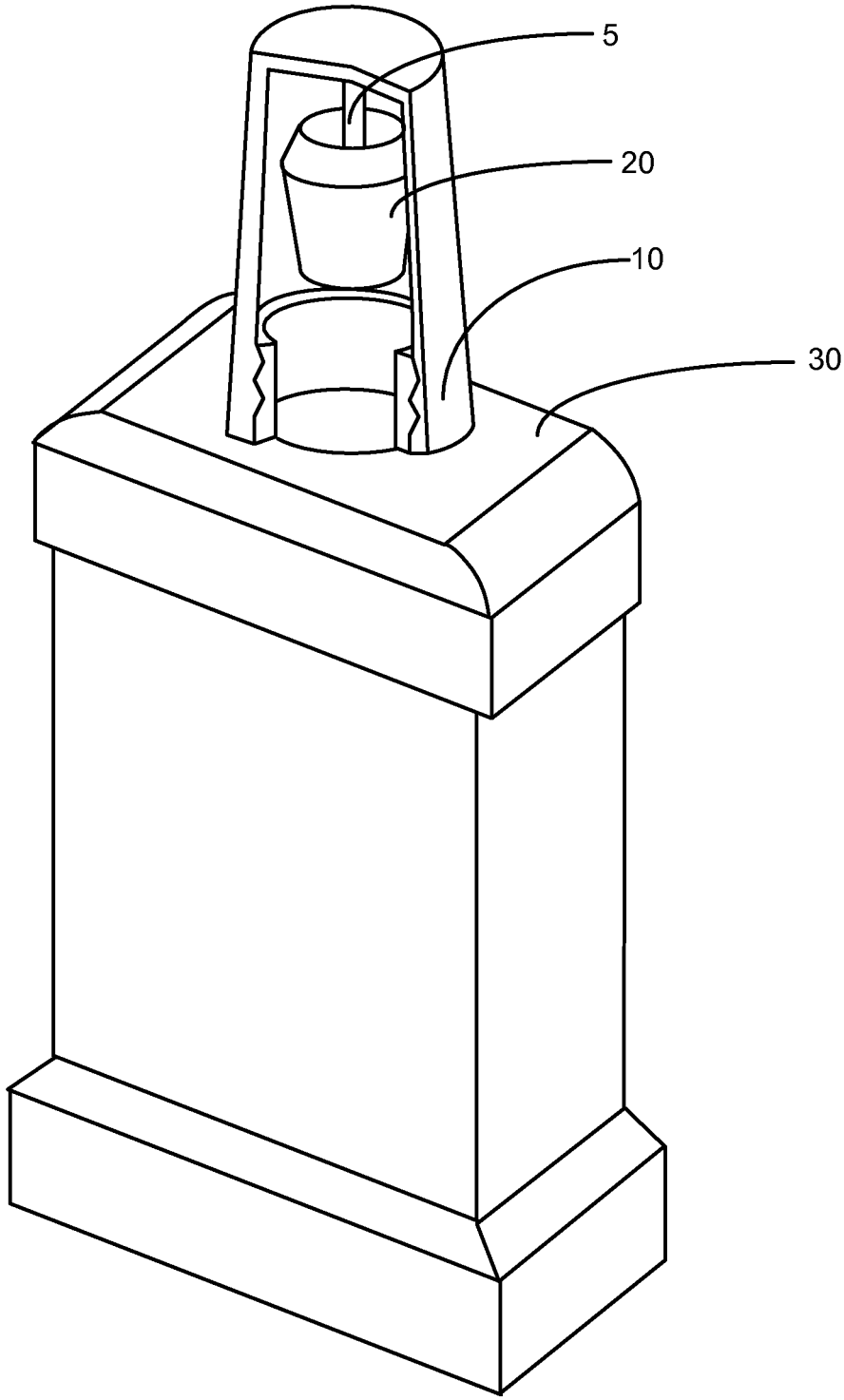
FIG. 1 is a perspective view of a bottle cap and bottle combination according to at least one embodiment of the bottle caps disclosed herein.

Referring to FIG. 1, the bottle cap according to at least one embodiment disclosed herein includes a bottle cap portion 10 and an inner cup 20. Each of the cap portion 10 and the inner cup 20 has a bottom and an opening, and a cavity in between the bottom and the opening. The inner cup 20 is preferably disposed within the cap portion 10 in an orientation upside down relative to the cap portion 10. That is, the opening of the inner cup 20 faces the opening of the cap portion 10 and is spaced a certain distance from the bottom of the cap portion 10 so that the cavities of each are in communication with each other. This allows liquid 40 to flow from the bottle 30 that the cap 10 is placed on into the cavity of inner cup 20, and from the cavity of the inner cup 20 into the cavity of the cap 10 when the bottle cap is tilted to the side and thereafter returned into an upright position. The bottle cap portion 10 may have a significantly smaller, e.g., shorter, inner cup 20 relative to the bottle cap portion 10, as shown, which beneficially allows the bottle cap to be used as a cup.

The cap portion 10 and the inner cup 20 are preferably attached to each other with a holder 5. The holder 5 generally maintains the position of the cup 20 relative to the cap portion 10. In one embodiment, the holder 5 is at least one rod that extends from the inside bottom surface of the bottle cap 10 to the inside bottom surface of the inner cup 20. The cup 20 may connect to the cap 10 with more than one holder 5, e.g., at least two or three holders, that connect the inside and/or outside of the cup 20 to the inside of the cap 10. The holder 5 may be connected to the bottle cap 10 and the inner cup portion in a variety of ways. In one embodiment, the ends of the holder 5 is bonded, e.g., glued, melted, etc., to the bottle cap portion 10 and the inner cup 20. The holder 5 may also be a molded part of the bottle cap portion 10 or the inner cup 20. In this instance, the holder 5 is preferably bonded to the inner cup 20 or the bottle cap portion 10, respectively, to fix the components 10, 20 together.

Figure 2:
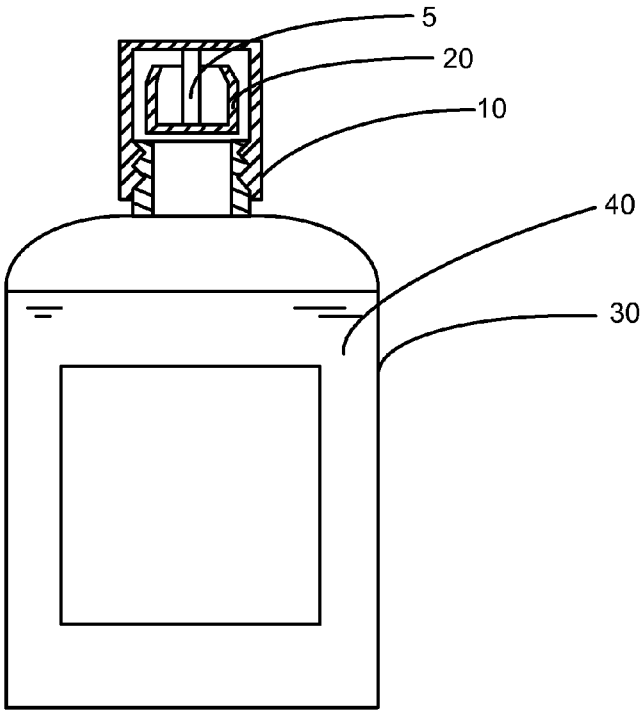
FIG. 2 is a cross sectional front view of a bottle cap and an at least partially liquid filled bottle combination according to at least one embodiment of the bottle caps disclosed herein.
Figure 3:
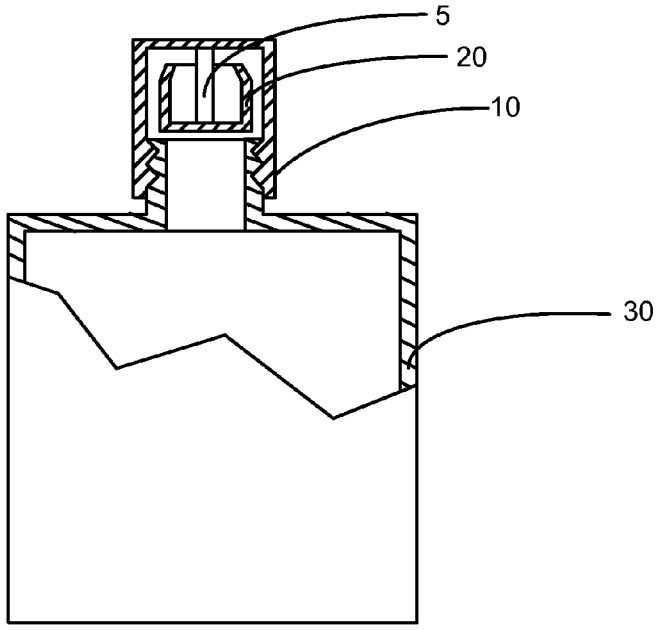
FIG. 3 is a partial cross sectional front view of a bottle cap and bottle combination according to at least one embodiment of the bottle caps disclosed herein.
Figure 4:
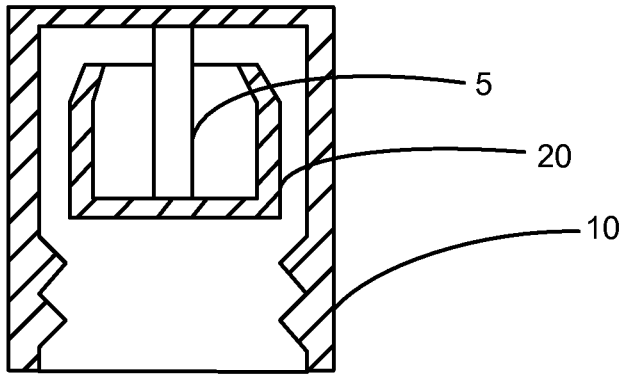
FIG. 4 is a cross sectional front view of a bottle cap according to at least one embodiment of the bottle caps disclosed herein.
Figure 5:
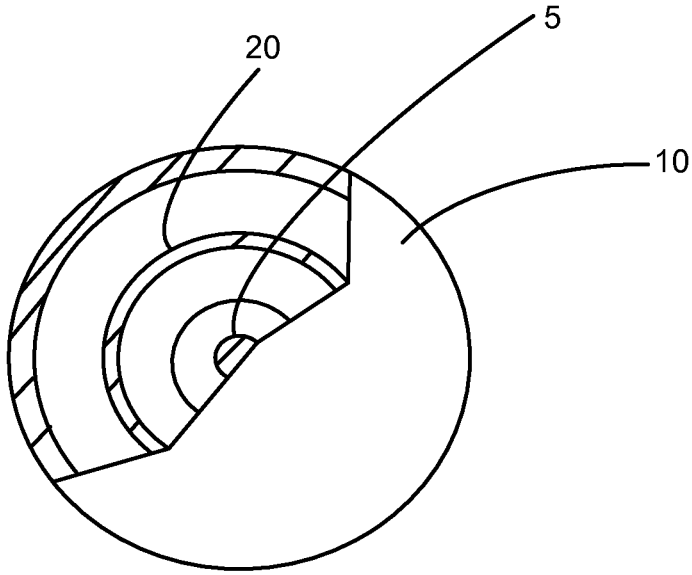
FIG. 5 is a partial cross sectional top view of a bottle cap according to at least one embodiment of the bottle caps disclosed herein.

Referring to FIGS. 2-5, in one embodiment, the smaller inner cup 20 is inserted in the middle of the cap portion 10 such that the cavities of the cup 20 and cap 10 remain in communication with each other around essentially the entire perimeter of the cup 20. This beneficially allows the liquid 40 to pour into and out of the cap 10 and cup 20 regardless of the alignment of the bottle cap. The cup 20 and cap 10 may be maintained relative to each other symmetrically or otherwise. Various types of symmetry may be maintained. In at least one embodiment, the cap 10 and cup 20 are bonded to each other such that each of the bottom of each of the cap portion 10 and the inner cup 20 share a common geometric center point as viewed from the top and as shown in FIG. 5. In this instance, the holder 5 may attach the inside bottom of the inner cup 20 to the inside top of the bottle cap 10 at the center point of the inner cup 20 and at the center point of the bottle cap 10. This relationship may be maintained with one or more, e.g., two, three, or more, thin rod holders 5, centrally disposed or otherwise. The cap 10 preferably includes inside threads or other means for removably attaching the bottle cap 10 to the bottle 30, as shown in FIG. 2.

Figure 6:
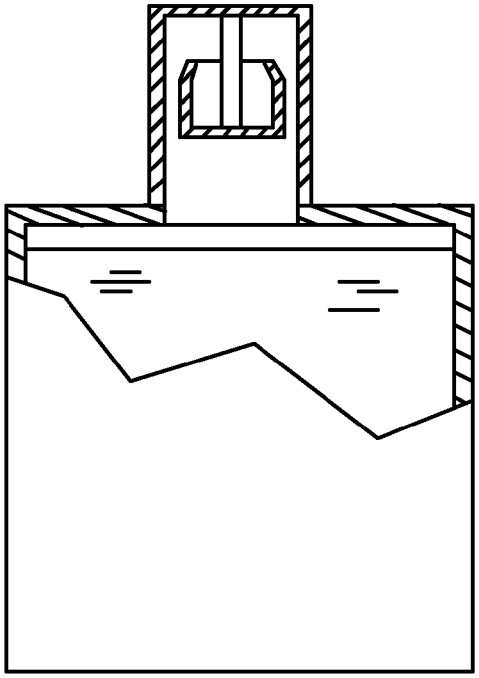
FIG. 6 is a partial cross sectional front view of a bottle cap and an at least partially liquid filled bottle combination according to at least one embodiment of the bottle caps disclosed herein with the bottle shown in a first, upright position.
Figure 7:
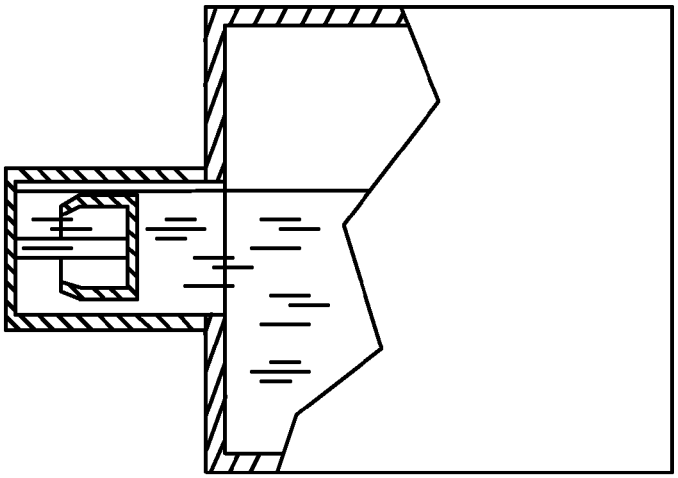
FIG. 7 is a partial cross sectional front view of a bottle cap and an at least partially liquid filled bottle combination according to at least one embodiment of the bottle caps disclosed herein with the bottle shown in a second, tilted to the side position.
Figure 8:
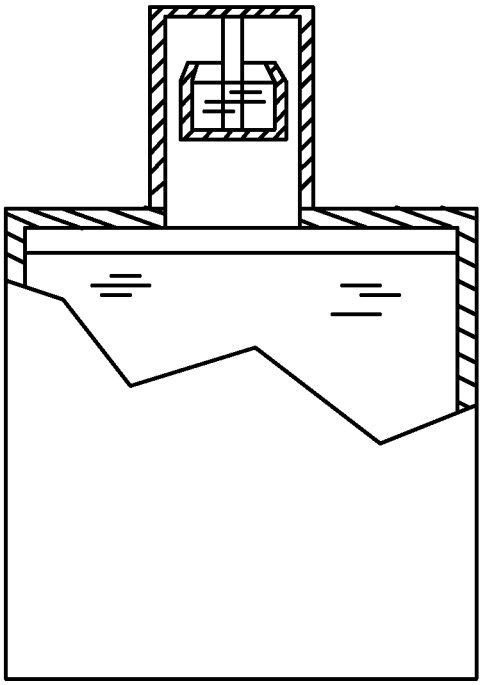
FIG. 8 is a partial cross sectional front view of a bottle cap and an at least partially liquid filled bottle combination according to at least one embodiment of the bottle caps disclosed herein with the bottle shown back in the first, upright position
Figure 9:
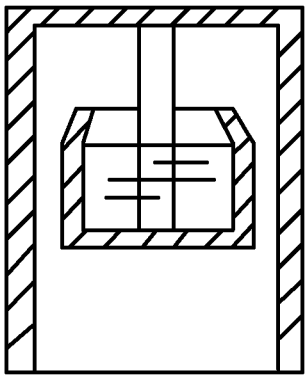
FIG. 9 is a cross sectional front view of a bottle cap according to at least one embodiment of the bottle caps disclosed herein with the bottle cap in the upright position after being removed from the bottle.
Figure 10:
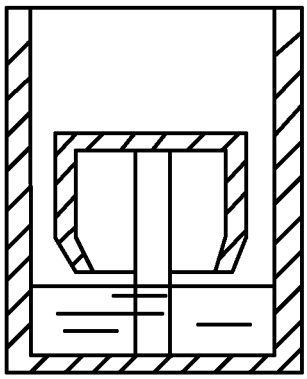
FIG. 10 is a cross sectional front view of a bottle cap according to at least one embodiment of the bottle caps disclosed herein with the bottle cap turned upside down after being removed from the bottle.
Figure 11:
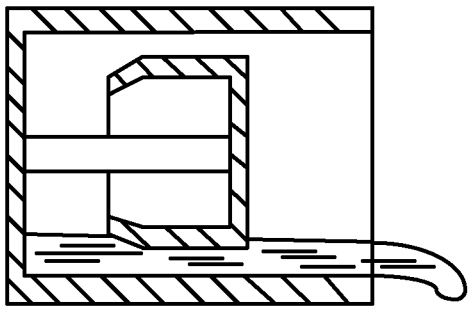
FIG. 11 is a cross sectional front view of a bottle cap according to at least one embodiment of the bottle caps disclosed herein with the bottle cap turned to its side after being removed from the bottle.

In operation, the bottle cap 10 and the liquid containing bottle combination is placed initially in a first, upright position as shown in FIG. 6. In the initial position, the cavity of the inner cup 20 is empty. The inner cup 20 may be filled with liquid 40 by tilting the bottle 30 to its side into a second position therewith allowing the liquid 40 to flow from the bottle 30 into the cavity of both the cap 10 and the inner cup 20, as shown in FIG. 7. Thereafter, the bottle 30 may be rotated back to the upright position, which will cause liquid 40 to flow out of the cap 10 while at least a portion of the liquid 40 remains captured in the inner cup 20, as shown in FIG. 8. The cap 10 may then be taken off from the bottle 30, as shown in FIG. 9, and tilted and/or flipped over, as shown in FIG. 10. This causes the liquid 40 remaining in the cup 20 to pour out of the cup 20 into the cap 10. At this moment the bottle cap 10 contains a certain amount, e.g., a metered or predetermined amount, of liquid that was trapped within the cup 20, which may then be poured out as shown in FIG. 11.

It is understood that several variations of the shape and sizes of the bottle cap portion 10, holder(s) 5, and inner cup 20 are possible. The shape of inner cup 20, for example, can be cylindrical with straight sides essentially perpendicular to the bottom of the cup 20, similar to the shape of an ordinary drinking glass. The cup 20 can also be at least partially conical, e.g., a frustum, with straight sides that extend other than perpendicular from the bottom of the cup 20. In this instance, the cup 20 appears as a trapezoid in a frontal cross sectional view of the cup 20. The trapezoid may either open or taper toward the opening of the cup 20. The cup 20 may also be a combination of a cylinder and a partial cone. That is, the cup 20 may be cylindrical toward the base followed by a frustum shape that tapers toward the opening of the cup 20 as shown, or in the reverse. The cup 20 may similarly be a combination of partial cones, with our without curved sides, so that the cup 20 appears as having a "wine barrel" or "pear" shape that also tapers toward the opening of the cup 20. The cup 20 can also be shaped like a "water drop", with a narrow top and a wider bottom, or in the reverse. The shape of the bottle cap 10 can be more ergonomic, e.g., one that more closely resembles a "pear" or "wine barrel" shape, than the one depicted in the figures.

Tapering the sides of inner cup 20 toward the opening beneficially prevents the liquid 40 in the cup 20 from spilling out except if/when the bottle cap 10 is tilted sufficiently for the tapered side of the cup 20 passes the horizontal level. Alternatively, the sides of the inner cup 20 can open or be wider at the top in order to catch more liquid within the cup 20. The quantity or amount of the liquid 40 captured in the inner cap 20 can be adjusted by varying the size of the inner cap 20 and/or the distance between inner cup 20 and the cap 10.

The inner holders 5 can vary in numbers as noted herein. The holders 5 generally connect the inner cup 20 with the bottle cap 10 and keep the cup 20 inside of the bottle cap 10 thereby making the cup 20 an essential or fixed part of the bottle cap 10. In some embodiments, the cap 10 includes inside threads for removably connecting the cap 10 to the bottle 30 that are located at the very bottom of the cap 10. In this case, the holders 5 may need to be located on or near the top of the opening of the inner cap 20 and continue until the holders 5 meet the bottom of the inside of the bottle cap 10.

The caps disclosed herein may be produced in a variety of ways. In one embodiment, the bottle cap 10 can be made with holders 5 attached thereto. The inner cup 20 can be attached to the holders 5 by gluing or by melting the ends of the holders 5 thereby bonding the cap 10 and cup 20 together. The cap can also be made in the opposite direction. That is, the inner cup 10 may be made with holders 5 attached thereto. The inner cap 10 can be attached to the holders 5 by bonding the cap 10 to the bottoms of holders 5.

It is understood that the cap 10 and cup 20 may be produced in any time of material including, without limitation, plastics, metals or alloys thereof, glass, ceramics, composites, etc., or a combination thereof. The cap 10 and cup 20 may also be made in any size to satisfy a particular need for a metered amount of the liquid 40.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated.

What is claimed is:

1. A bottle cap comprising:

a cap portion having an opening at one end, a bottom at another end, and a side extending between the opening and the bottom end, the bottom and the side forming a cavity in the cap portion;

a cup having an opening at one end, a bottom at another end, and a side extending between the opening and the bottom end, the bottom and the side forming a cavity in the cup, wherein the bottom of the cup is fixed to the side of the cup, the cup is disposed within the opening of the cap portion in a direction upside down relative to the cap portion, the opening of the cup is spaced a distance away from the bottom of the cap portion such that the cavities of each of the cap portion and the cup are in communication with each other, the opening of the cup is located within the cavity in the cap portion, and wherein the cup is circumferentially smaller than the cap portion such that a space is created between the cup and the cap portion for liquid in the cup cavity to pass through, wherein the cup opening has a perimeter and wherein the cup is disposed within the cap portion such that the cap portion and the cup are in communication with each other along essentially the entire perimeter of the cup opening; and at least one holder that connects the cap portion and the cup, and that maintains the cup in a fixed relationship to the cap portion, wherein the bottoms of each of the cap portion and the cup have a geometric center point and wherein the center point of the cup is aligned with the center point of the cap portion so that the cup and cap share a common center point as viewed from a top of the cap or the cup, and wherein the at least one holder has a first end and a second end opposite the first end, the first end of the holder extends from a center point of the bottom of the cap portion to a center point of the bottom of the cup, and wherein the space created between the cup and the cap portion is continuous around a perimeter of the cup opening.

2. The bottle cap of claim 1, wherein at least one holder has a first end and a second end opposite the first end, and wherein the first end of the holder extends from the bottom of the cap portion to the bottom of the cup.

3. The bottle cap of claim 1, wherein the at least one holder is molded as a single part with one of the cap portion and the cup and wherein the at least one holder is bonded to one of the cup and cap portion, respectively.

4. The bottle cap of claim 1, wherein the cap portion comprises inside threads for removably coupling the bottle cap to a bottle.

5. The bottle cap of claim 1, wherein the cup has an essentially cylindrical shape with the side essentially perpendicular to the bottom of the cup.

6. The bottle cap of claim 1, wherein the cup has a composite shape that comprises at least two different geometric shapes.

7. The bottle cap of claim 6, wherein at least one of the geometric shapes comprises a partial cone that tapes toward the opening of the cap.

8. The bottle cap of claim 6, wherein the at least one of the geometric shapes comprises a cylinder situated toward the bottom of the cup and wherein the partial cone is situated toward the opening of the cup.

9. A bottle cap comprising:

a cap portion having an opening at one end, a bottom at another end, and a side extending between the opening and the bottom end, the bottom and the side forming a cavity in the cap portion;

a cup having an opening at one end, a bottom at another end, and a side extending between the opening and the bottom end, the bottom and the side forming a cavity in the cup, wherein the cup is disposed within the opening of the cap portion in a direction upside down relative to the cap portion, the opening of the cup is spaced a distance away from the bottom of the cap portion such that the cavities of each of the cap portion and the cup are in communication with each other, the opening of the cup is located within the cavity in the cap portion, and wherein the cup is circumferentially smaller than the cap portion such that a space is created between the cup and the cap portion for liquid in the cup cavity to pass through; and at least one holder having a first end and a second end opposite the first end that connects the cap portion and the cup and that maintains the cup in a fixed relationship to the cap portion, wherein the cup opening has a perimeter, the cup is disposed within the cap portion such that the cap portion and the cup are in communication with each other along essentially the entire perimeter of the cup opening, the space created between the cup and the cap portion is continuous around the entire perimeter of the cup opening, and wherein the bottoms of each of the cap portion and the cup have a geometric center point and wherein the center point of the cup is aligned with the center point of the cap portion so that the cup and cap share a common center point as viewed from a top of the cap or the cup, and the first end of the holder extends from the center point of the bottom of the cap portion to the center point of the bottom of the cup, and wherein the holder forms the only connection between the cap portion and the cup.

* * * * *